US008757247B2

(12) United States Patent
Yang et al.

(10) Patent No.: US 8,757,247 B2
(45) Date of Patent: Jun. 24, 2014

(54) HEAT PIPE STRUCTURE

(75) Inventors: Hsiu-Wei Yang, New Taipei (TW); Ming-Tai Weng, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 442 days.

(21) Appl. No.: 13/043,482

(22) Filed: Mar. 9, 2011

(65) Prior Publication Data

US 2012/0180994 A1 Jul. 19, 2012

(30) Foreign Application Priority Data

Jan. 18, 2011 (TW) ..... 100201078 A

(51) Int. Cl.
*F28D 15/00* (2006.01)

(52) U.S. Cl.
USPC ..... 165/104.26; 165/104.21; 165/104.33

(58) Field of Classification Search
USPC ..... 165/104.26, 104.19, 104.21, 177, 179
See application file for complete search history.

(56) References Cited

U.S. PATENT DOCUMENTS

| | | | | |
|---|---|---|---|---|
| 5,184,672 | A * | 2/1993 | Aoki | 165/109.1 |
| 7,025,124 | B2 * | 4/2006 | Wang et al. | 165/104.21 |
| 7,646,608 | B2 * | 1/2010 | Thompson et al. | 361/711 |
| 7,770,631 | B2 * | 8/2010 | Wang | 165/104.26 |
| 2005/0126758 | A1 * | 6/2005 | Schulz-Harder | 165/104.21 |
| 2007/0240860 | A1 * | 10/2007 | Meyer et al. | 165/104.26 |
| 2007/0295486 | A1 * | 12/2007 | Su et al. | 165/104.26 |
| 2008/0029249 | A1 * | 2/2008 | Hsiao | 165/104.26 |
| 2009/0025910 | A1 * | 1/2009 | Hoffman et al. | 165/104.26 |
| 2009/0040726 | A1 * | 2/2009 | Hoffman et al. | 361/700 |
| 2009/0194259 | A1 * | 8/2009 | Meyer et al. | 165/104.26 |
| 2009/0205812 | A1 * | 8/2009 | Meyer et al. | 165/104.26 |
| 2010/0294200 | A1 * | 11/2010 | Zhang et al. | 118/728 |

* cited by examiner

*Primary Examiner* — Allen Flanigan
*Assistant Examiner* — Jason Thompson

(57) ABSTRACT

A heat pipe structure includes a pipe body, a thin-sheet member, and a plurality of bosses. The pipe body internally defines a receiving space, in which a working fluid is provided. The thin-sheet member includes a plurality of first extended sections and a plurality of second extended sections. The first and the second extended sections are connected to and intersected with one another to thereby define a plurality of intersections and open spaces on the thin-sheet member. The bosses are provided on at least some of the intersections of the first and the second extended sections to provide supporting strength for the heat pipe structure as well as vapor-liquid circulation of the working fluid in the heat pipe structure.

9 Claims, 6 Drawing Sheets

HEAT PIPE STRUCTURE

This application claims the priority benefit of Taiwan patent application number 100201078 filed on Jan. 18, 2011.

FIELD OF THE INVENTION

The present invention relates to a heat pipe structure, and more particularly to a heat pipe structure that enables increased supporting strength of a flat heat pipe and increased good yield of heat pipe.

BACKGROUND OF THE INVENTION

In the constant technological progress nowadays, the removal of cold or heat is still a big hindrance to the development in the electronic industry. Following the demands for high performance, increased integration and multifunctional applications, the whole electronic industry has to challenge the requirement for good heat dissipation and takes it as a major task to work out a way for upgrading heat transfer efficiency.

A heat sink is usually employed to dissipate heat produced by electronic elements or electronic systems into air. It has been found a heat sink with lower thermal resistance would provide higher heat dissipation efficiency. Generally speaking, thermal resistance consists of spreading resistance existed in the heat sink and convection resistance existed between the surface of the heat sink and the ambient air. In actual application, materials with high thermal conductivity, such as copper and aluminum, are frequently used in the manufacturing of heat sinks with reduced spreading resistance. However, the convection resistance still exists to limit the performance of heat sinks and thereby prevents the new generation of electronic elements from achieving the required heat dissipation efficiency.

Thus, heat dissipation mechanisms capable of providing higher heat dissipation efficiency have drawn consumers' attention in the market. For example, thin heat pipes and vapor chambers with high thermal transfer performance have been used with heat sinks in an attempt to effectively solve the present heat dissipation problem.

The currently available thin heat pipe structure includes a thin pipe body having a hollow space therein. Metal powder is put in the hollow space of the thin pipe body and sintered to form a wick structure on an inner wall surface of the thin pipe body. Alternatively, a metal net structure is arranged in the hollow space of the thin pipe body to serve as a wick structure. Then, the thin pipe body is vacuumed and filled with a working fluid before being sealed to complete a thin heat pipe structure. The conventional thin heat pipe structure does not include any internal supporting structure and is therefore subject to collapse or thermal expansion. When the conventional thin heat pipe structure is subjected to pressure, the wick structure, i.e. the sintered metal powder in the thin pipe body is compressed and damaged to peel off from the inner wall surface of the thin pipe body, which results in largely reduced heat transfer performance of the thin heat pipe structure. Further, with the sintered wick structure formed on the inner wall surface of the thin pipe body or with the metal net structure arranged in the hollow space of the thin pipe body, the working fluid condensed from vapor into liquid flows from the cold end of the heat pipe structure back to the hot end only with the help of gravity or the wick structure on the inner wall surface of the thin pipe body. Thus, the conventional thin heat pipe structure has relatively low vapor-liquid circulation efficiency.

Taiwan New Utility Model Patent Number M336673 discloses a vapor chamber and supporting structure thereof. The vapor chamber includes an enclosure defining a hollow space therein, as well as a wick structure and a supporting structure provided in the enclosure. The supporting structure includes a plate, on which a plurality of symmetrically arranged and spaced channels is provided. In each of the channels, there is formed a corrugated sheet. The corrugated sheets respectively have an upper and a lower end pressed against the wick structure, so that the wick structure is brought to bear on inner wall surfaces of the enclosure. With the corrugated sheets provided in the hollow space of the vapor chamber, the sintered wick structure is prevented from peeling off or collapsing in the vapor chamber and both of the vapor-phase change and the heat transfer speed are increased. However, the corrugated sheets do not provide any significant help in the back flowing of the liquidized working fluid to the hot end or enabling increased capillary limit.

Therefore, the supporting structure in the prior art vapor chamber or thin heat pipe structure still requires improvement. In brief, the prior art chamber and thin heat pipe structure have the following disadvantages: (1) low good yield in production; (2) low vapor-liquid circulation efficiency; and (3) poor internal supporting strength.

SUMMARY OF THE INVENTION

It is therefore a primary object of the present invention to provide a heat pipe structure for overcoming the technical drawbacks in the conventional heat pipe structures.

To achieve the above and other objects, the heat pipe structure according to the present invention includes a pipe body, a thin-sheet member, and a plurality of bosses.

The pipe body internally defines a receiving space, and has a first and a second closed end connected to two opposite ends of the receiving space. A working fluid is provided in the receiving space. The thin-sheet member is arranged in the receiving space of the pipe body, and includes a plurality of first extended sections and a plurality of second extended sections, which are connected to and intersected with one another to thereby define a plurality of intersections and open spaces on the thin-sheet member. The bosses are located on at least some of the intersections of the first and the second extended sections with respective two ends connected to the thin-sheet member and an inner wall surface of the pipe body.

The plurality of open spaces formed on the thin-sheet member functions to increase the liquid-vapor phase change in the heat pipe structure and accordingly increases the heat transfer rate of the heat pipe structure. The bosses provided on the thin-sheet member provide the pipe body with increased supporting strength. In the case of sintered powder bosses, their wick structure not only helps the liquidized working fluid to flow back at an increased speed, but also enables an increased capillary limit.

In brief, with the above arrangements, the heat pipe structure of the present invention can have largely increased supporting strength and provide largely upgraded heat transfer efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
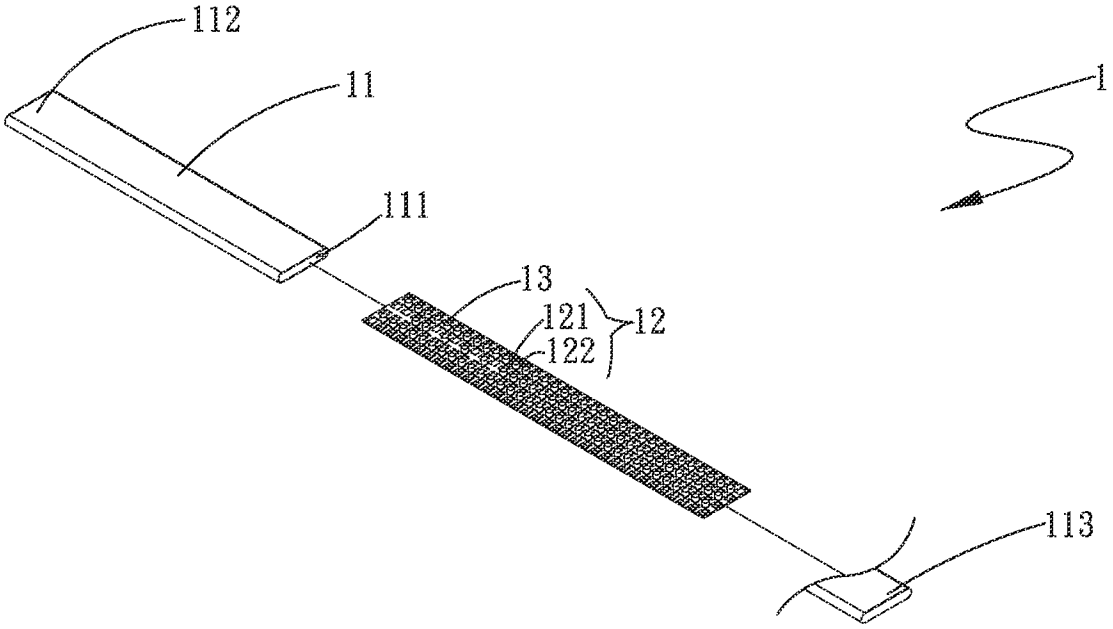
FIG. 1 is an exploded perspective view of the heat pipe structure of the present invention according to a first embodiment thereof.

The present invention will now be described with some preferred embodiments thereof and with reference to the accompanying drawings. For the purpose of easy to understand, elements that are the same in the preferred embodiments are denoted by the same reference numerals.

Figure 2:
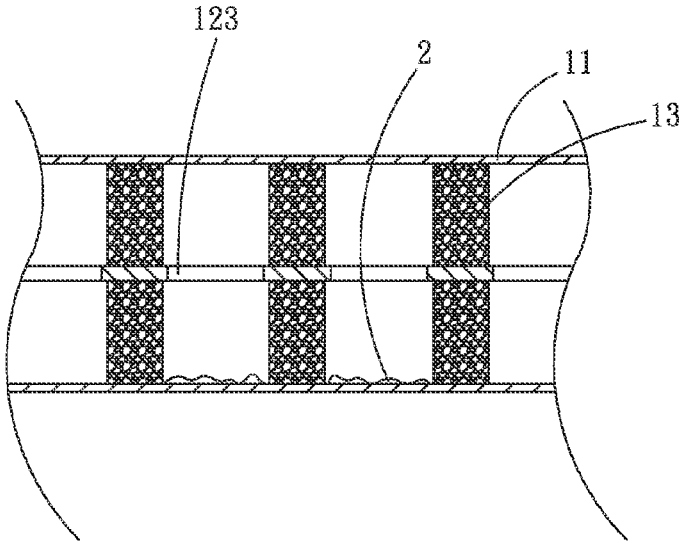
FIG. 2 is a fragmentary longitudinal sectional view of the heat pipe structure of FIG. 1 in an assembled state.

Please refer to FIGS. 1 and 2 that are exploded perspective view and assembled longitudinal sectional view, respectively, of a heat pipe structure 1 of the present invention according to a first embodiment thereof. As shown, the heat pipe structure 1 in the first embodiment includes a pipe body 11, a thin-sheet member 12, and a plurality of bosses 13.

The pipe body 11 internally defines a receiving space 111 and has a first closed end 112 and an opposite second closed end 113 connected to two opposite ends of the receiving space 111. A working fluid 2 is provided in the receiving space 111. And, the pipe body 11 is a flat pipe body having a low profile.

The thin-sheet member 12 is arranged in the receiving space 111 of the pipe body 11, and includes a plurality of first extended sections 121 and a plurality of second extended sections 122. The first and the second extended sections 121, 122 are connected to and intersected with one another to together define a plurality of intersections and a plurality of open spaces 123 on the thin-sheet member 12.

The first extended sections 121 are extended in a longitudinal direction of the thin-sheet member 12, while the second extended sections 122 are extended in a transverse direction of the thin-sheet member 12.

The bosses 13 are sintered powder bodies and are selectively located at some of the intersections of the first and the second extended sections 121, 122, as shown in FIG. 1. Two ends of the bosses 13 are separately connected to the thin-sheet member 12 and an inner wall surface of the pipe body 11.

Figure 3:
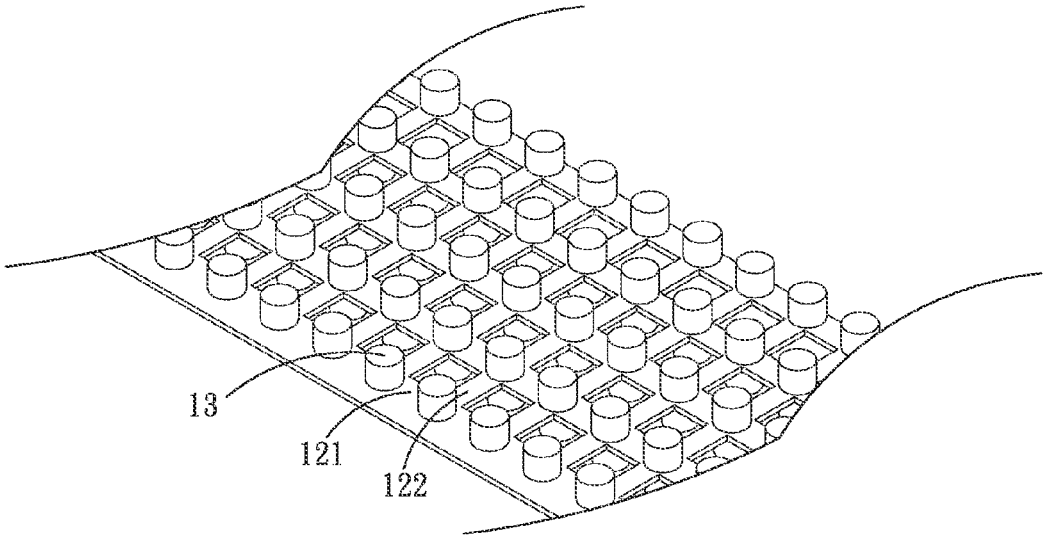
FIG. 3 is a perspective view of a thin-sheet member used in the heat pipe structure of the present invention according to a second embodiment thereof.

Please refer to FIG. 3 that is a fragmentary perspective view of the thin-sheet member 12 used in the heat pipe structure 1 of the present invention according to a second embodiment thereof. As shown, the thin-sheet member 12 in the second embodiment is generally structurally similar to the thin-sheet member 12 in the first embodiment, except that all the intersections of the first and the second extended sections 121, 122 on the thin-sheet member 12 in the second embodiment have a boss 13 formed thereat.

Figure 4:
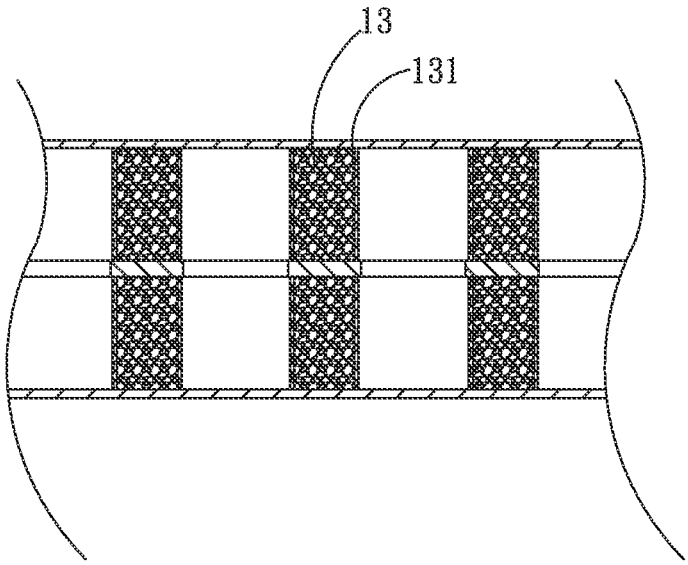
FIG. 4 is a fragmentary longitudinal sectional view of the heat pipe structure of the present invention according to a third embodiment thereof in an assembled state.

FIG. 4 is a fragmentary longitudinal sectional view of the heat pipe structure of the present invention according to a third embodiment thereof in an assembled state. As shown, the heat pipe structure in the third embodiment is generally structurally similar to that in the first embodiment, except that the bosses 13 in the third embodiment are provided on respective outer surface with at least one groove 131.

Figure 5:
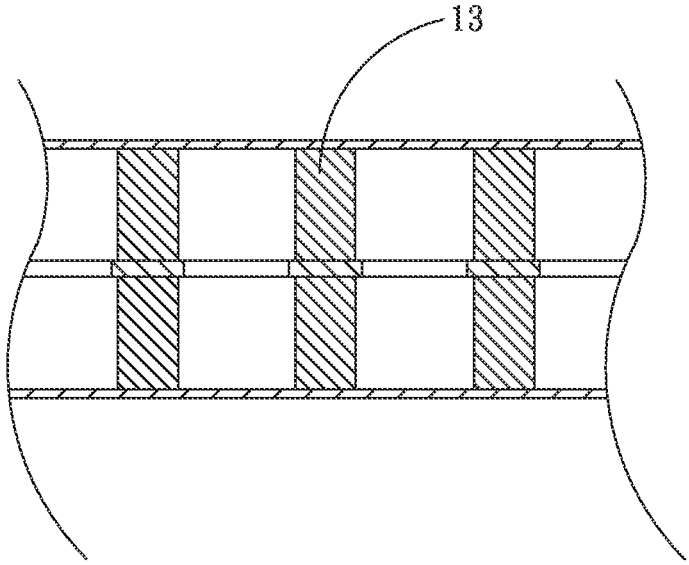
FIG. 5 is a fragmentary longitudinal sectional view of the heat pipe structure of the present invention according to a fourth embodiment thereof in an assembled state.

FIG. 5 is a fragmentary longitudinal sectional view of the heat pipe structure of the present invention according to a fourth embodiment thereof in an assembled state. As shown, the heat pipe structure in the fourth embodiment is generally structurally similar to that in the first embodiment, except that the bosses 13 in the fourth embodiment are copper bosses.

Figure 6:
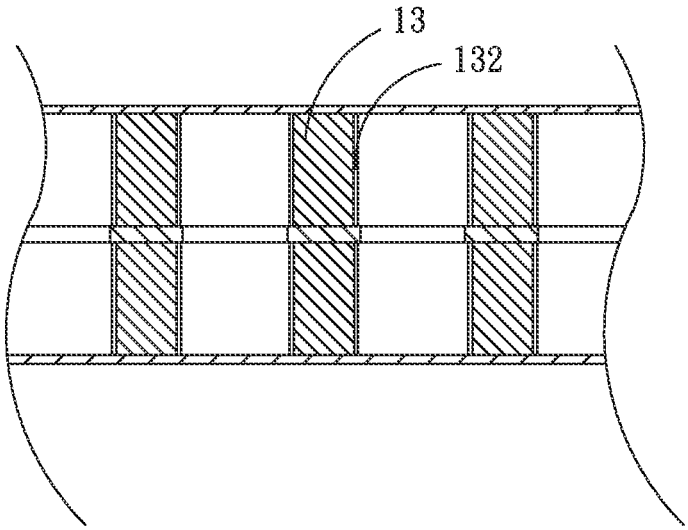
FIG. 6 is a fragmentary longitudinal sectional view of the heat pipe structure of the present invention according to a fifth embodiment thereof in an assembled state.

FIG. 6 is a fragmentary longitudinal sectional view of the heat pipe structure of the present invention according to a fifth embodiment thereof in an assembled state. As shown, the heat pipe structure in the fifth embodiment is generally structurally similar to that in the fourth embodiment, except that the bosses 13 in the fifth embodiment are provided on respective outer surface with at least one groove 132.

Figure 7:
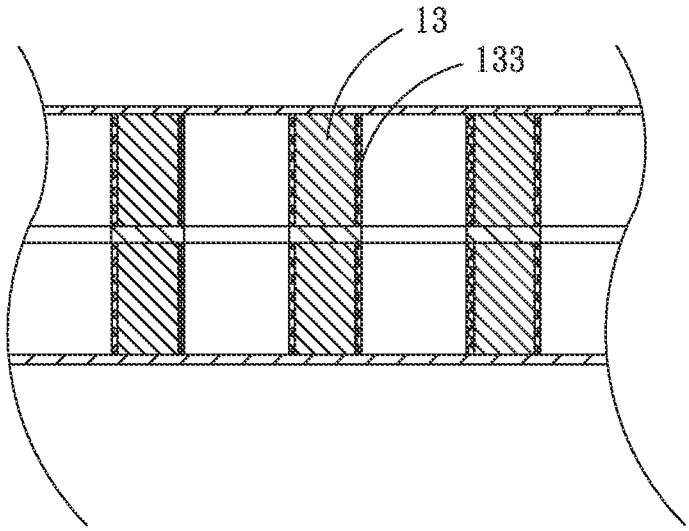
FIG. 7 is a fragmentary longitudinal sectional view of the heat pipe structure of the present invention according to a sixth embodiment thereof in an assembled state.

Please refer to FIG. 7 that is a fragmentary longitudinal sectional view of the heat pipe structure of the present invention according to a sixth embodiment thereof in an assembled state. As shown, the heat pipe structure in the sixth embodiment is generally structurally similar to that in the fourth embodiment, except that the bosses 13 in the sixth embodiment are provided on respective outer surface with a ring-shaped sintered powder body 133.

Figure 8:
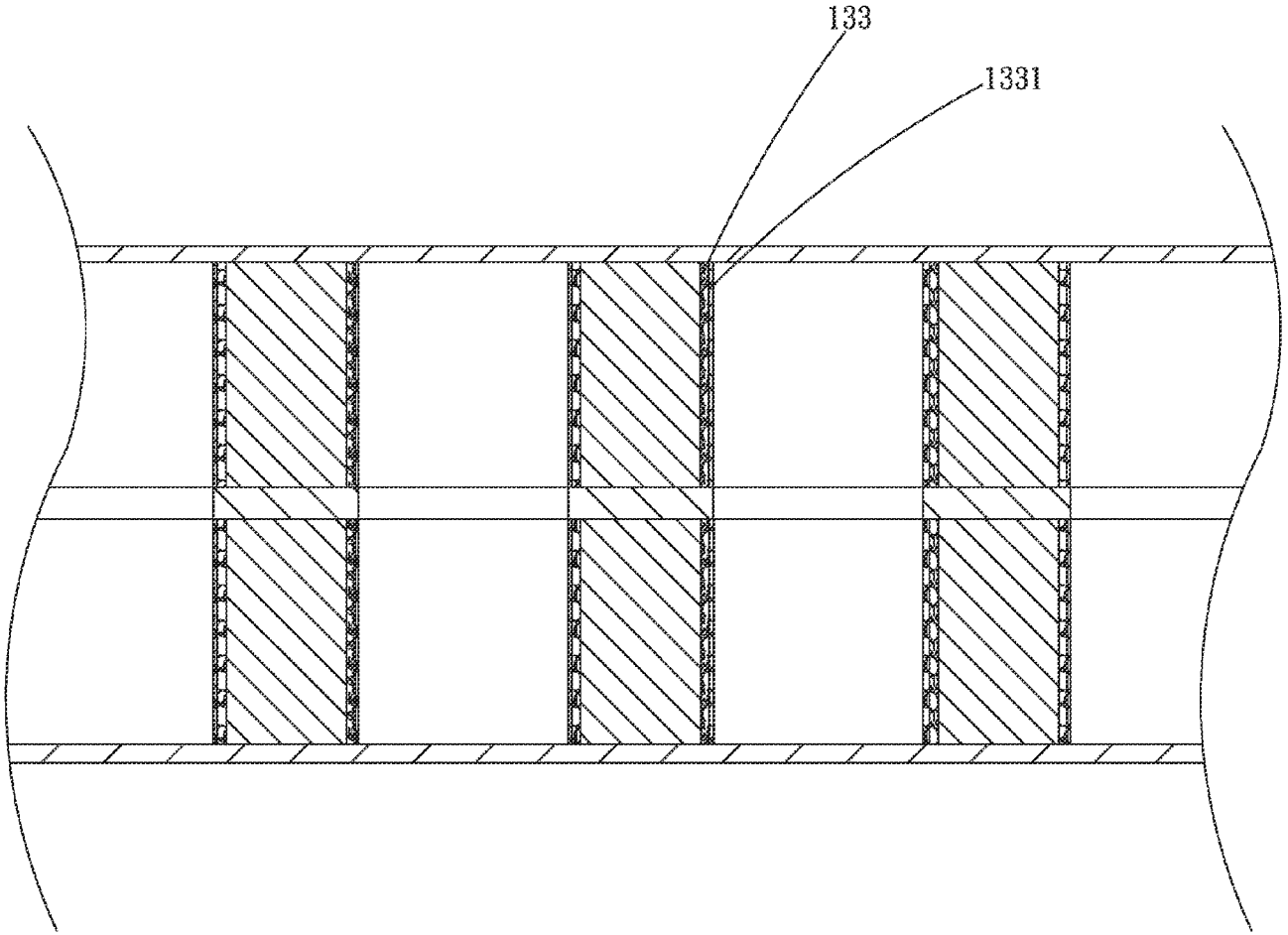
FIG. 8 is a fragmentary longitudinal sectional view of the heat pipe structure of the present invention according to a seventh embodiment thereof in an assembled state.

Please refer to FIG. 8 that is a fragmentary longitudinal sectional view of the heat pipe structure of the present invention according to a seventh embodiment thereof in an assembled state. As shown, the heat pipe structure in the seventh embodiment is generally structurally similar to that in the sixth embodiment, except that the bosses 13 in the seventh embodiment are provided on respective ring-shaped sintered power body 133 with at least one groove 1331.

Figure 9:
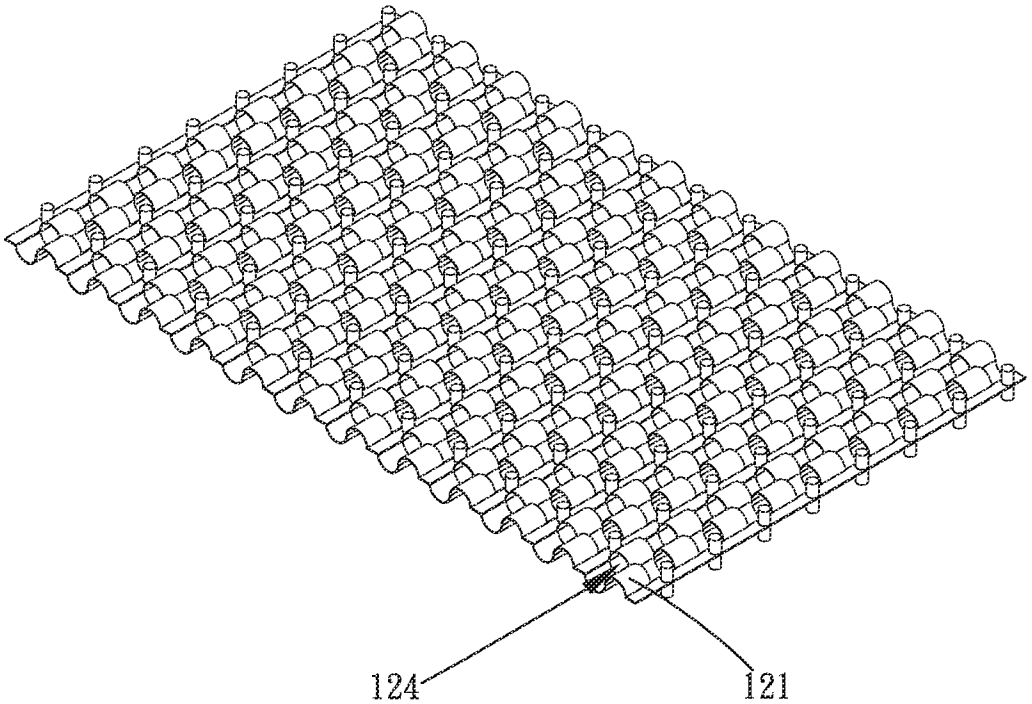
FIG. 9 is a perspective view of a thin-sheet member used in the heat pipe structure of the present invention according to an eighth embodiment thereof.

FIG. 9 is a perspective view of the thin-sheet member used in the heat pipe structure of the present invention according to an eighth embodiment thereof. As shown, the thin-sheet member in the eighth embodiment is generally structurally similar to the thin-sheet member in the first embodiment, except that the first extended sections 121 of the thin-sheet member in the eighth embodiment respectively have a curved shape, and each of the curved first extended sections 121 defines a passage 124 at a concaved side thereof.

In the previously described embodiments of the present invention, the provision of the bosses 13 on the thin-sheet member 12 not only gives the heat pipe structure 1 an increased supporting strength, but also increases the vapor-liquid circulation efficiency inside the heat pipe structure 1, allowing the liquidized working fluid 2 to flow back from the bosses 13 and accordingly, enabling the heat pipe structure 1 to have increased heat transfer efficiency.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A heat pipe structure, comprising:

a pipe body internally defining a receiving space and having a first closed end and a second closed end connected to two opposite ends of the receiving space, and having a working fluid provided in the receiving space;

a thin-sheet member being arranged in the receiving space of the pipe body and including a plurality of first extended sections and a plurality of second extended sections, the first and the second extended sections being connected to and intersected with one another to thereby together define a plurality of intersections and open spaces on the thin-sheet member; and a plurality of bosses including a plurality of first and second bosses, wherein the first and second bosses are respectively located on opposite surfaces of the thin sheet member such that each first boss is positioned directly opposite to a corresponding second boss.

2. The heat pipe structure as claimed in claim 1, wherein the first extended sections are extended in a longitudinal direction of the thin-sheet member.

3. The heat pipe structure as claimed in claim 1, wherein the second extended sections are extended in a transverse direction of the thin-sheet member.

4. The heat pipe structure as claimed in claim 1, wherein the pipe body is a flat pipe body.

5. The heat pipe structure as claimed in claim 1, wherein the bosses are copper bosses and are provided on respective outer surface with at least one groove.

6. The heat pipe structure as claimed in claim 1, wherein the bosses are sintered powder bodies and are provided on respective outer surface with at least one groove.

7. The heat pipe structure as claimed in claim 1, wherein the bosses are sintered powder bodies.

8. The heat pipe structure as claimed in claim 1, wherein the bosses are copper bosses and are provided on respective outer surface with a ring-shaped sintered powder body.

9. The heat pipe structure as claimed in claim 1, wherein the first extended sections respectively have a curved shape, and each of the curved first extended sections defines a passage at a concaved side thereof.

* * * * *